US005797163A

United States Patent [19]

Whitaker et al.

[11] Patent Number: 5,797,163

[45] Date of Patent: Aug. 25, 1998

[54] LIQUID EXTRACTION MACHINE

[75] Inventors: Emert Robert Whitaker, Siloam Springs; Lenard Keith Deiterman; Michael Gerald Kramer, both of Springdale, all of Ark.

[73] Assignee: Clarke Industries, Inc., Springdale, Ark.

[21] Appl. No.: 686,821

[22] Filed: Jul. 26, 1996

[51] Int. Cl.[6] ..... A47L 11/00; A47L 13/00

[52] U.S. Cl. ..... 15/413; 15/320; 15/340.2; 165/47

[58] Field of Search ..... 15/320, 340.1, 15/340.2, 340.3, 340.4, 412, 413; 165/47

[56] References Cited

U.S. PATENT DOCUMENTS

| | | | |
|---|---|---|---|
| 2,898,621 | 8/1959 | Vance . | |
| 3,454,978 | 7/1969 | Kuwahara . | |
| 3,854,164 | 12/1974 | Schmitz . | |
| 3,962,746 | 6/1976 | Johnson et al. | 15/413 |
| 4,361,928 | 12/1982 | Schulz . | |
| 4,454,627 | 6/1984 | Simm et al. . | |

OTHER PUBLICATIONS

Clarke Sales Brochure "Clarke® Family Of . . . Self Contained Extractors", published Aug. 1993.

*Primary Examiner*—Terrence Till

*Attorney, Agent, or Firm*—Senniger, Powers, Leavitt & Roedel

[57] ABSTRACT

An extraction machine of this invention comprises a main housing. A vacuum pump in the main housing operates to create a vacuum to extract liquid from the surface. A motor in the main housing drives the vacuum pump, the vacuum pump having an exhaust. An exhaust duct conducts exhaust air from the exhaust of the vacuum pump to an opening in the main housing for exhaust to the environment. A constriction in the exhaust duct reduces the pressure of exhaust air flowing through the exhaust duct from a first pressure upstream from the constriction to a second lower pressure in a low pressure zone adjacent the constriction. A compartment has an inlet for entry of ambient air into the compartment and an outlet for exit of air from the compartment. A second motor is located within the compartment. A cooling duct has an inlet communicating with the outlet of the compartment and an outlet communicating with the low pressure zone in the exhaust duct. The second lower pressure of the exhaust air in the low pressure zone is less than ambient pressure thereby to cause a flow of cooling ambient air into the compartment, through the compartment and into the cooling duct, and then into the exhaust duct for exhaust out of the main housing.

18 Claims, 4 Drawing Sheets

LIQUID EXTRACTION MACHINE

BACKGROUND OF THE INVENTION

This invention relates generally to an extraction machine used for cleaning floor surfaces with a cleaning liquid and then extracting the liquid from the floor, and more particularly to such an extraction machine having an improved, more efficient cooling system.

In extraction machines of conventional design, a solution tank contained within the machine housing releases a cleaning solution onto the surface to be cleaned, such as a carpet. A scrub brush, driven by a brush motor, works the cleaning solution into the carpet to effect cleaning of the carpet, leaving a dirty solution within the carpet. During operation, the machine is self-propelled or moved manually to pass over the dirty solution so that a vacuum shoe attached to the machine remains in contact with the carpet and collects the dirty solution. A vacuum pump driven by a vacuum motor creates a vacuum within a recovery tank which communicates with the shoe by means of a recovery line extending between the recovery tank and the shoe. Suction created by the vacuum pump extracts the dirty cleaning solution from the carpet, resulting in a cleaned carpet. The dirty solution is suctioned through the shoe and recovery line into the recovery tank carried by the machine. The cooling system of conventional extraction machines typically includes fan units driven either by the vacuum motor or by a secondary motor to draw cool air into the housing through openings in the housing. The air drawn into the housing effects cooling of the various motors and electrical devices operating within the housing. Extraction machines of this type have been made by various companies, including Clarke Industries, Inc. which sells such machines under the trademark CLARKE®.

The cooling system used in conventional extraction machines and described above is not as efficient as desired, resulting in wasted energy and increased manufacturing and operating costs. There is a need, therefore, for an extraction machine with a cooling system having more efficient cooling characteristics without the use of additional fan units.

SUMMARY OF THE INVENTION

Among the several objects of this invention may be noted the provision of an extraction machine with an improved cooling system having more efficient cooling characteristics; the provision of such an extraction machine which results in more cooling air being directed to secondary motors; the provision of such an extraction machine which is easy to construct; the provision of such an extraction machine which is less expensive to manufacture; the provision of such an extraction machine which is capable of improved cooling with less energy consumption; and the provision of a cooling system which can be used with multiple types of machines which employ two or more motors.

Briefly, an extraction machine of this invention comprises a main housing. A vacuum pump in the main housing operates to create a vacuum to extract liquid from the surface. A motor in the main housing drives the vacuum pump, the vacuum pump having an exhaust. An exhaust duct conducts exhaust air from the exhaust of the vacuum pump to an opening in the main housing for exhaust to the environment. A constriction in the exhaust duct reduces the pressure of exhaust air flowing through the exhaust duct from a first pressure upstream from the constriction to a second lower pressure in a low pressure zone adjacent the constriction. A compartment has an inlet for entry of ambient air into the compartment and an outlet for exit of air from the compartment. A second motor is located within the compartment. A cooling duct has an inlet communicating with the outlet of the compartment and an outlet communicating with the low pressure zone in the exhaust duct. The second lower pressure of the exhaust air in the low pressure zone is less than ambient pressure thereby to cause a flow of cooling ambient air into the compartment, through the compartment and into the cooling duct, and then into the exhaust duct for exhaust out of the main housing.

A second aspect of this invention involves a cooling system for use in a machine of the type comprising a main housing having an opening therein, a motor-driven unit in the main housing, a compartment in the housing having an inlet for entry of ambient air into the compartment and an outlet for exit of air from the compartment, and a motor in the compartment. The cooling system comprises an exhaust duct for conducting exhaust air from the motor-driven unit to the opening in the main housing. A constriction in the exhaust duct reduces the pressure of exhaust air flowing through the exhaust duct from a first pressure upstream from the constriction to a second lower pressure in a low pressure zone adjacent the constriction. A cooling duct connects the outlet of the compartment to the low pressure zone in the exhaust duct. The second lower pressure of the exhaust air in the low pressure zone is less than ambient pressure, which causes a flow of cooling ambient air into the compartment, through the compartment and into the cooling duct, and then into the exhaust duct for exhaust through the exhaust duct outlet.

Other objects and features will become in part apparent and in part pointed out hereinafter.

BRIEF DESCRIPTION OF THE DRAWINGS

Corresponding parts are designated by corresponding reference characters and numerals throughout the several views of the drawings.

DESCRIPTION OF THE PREFERRED EMBODIMENT

Figure 1:
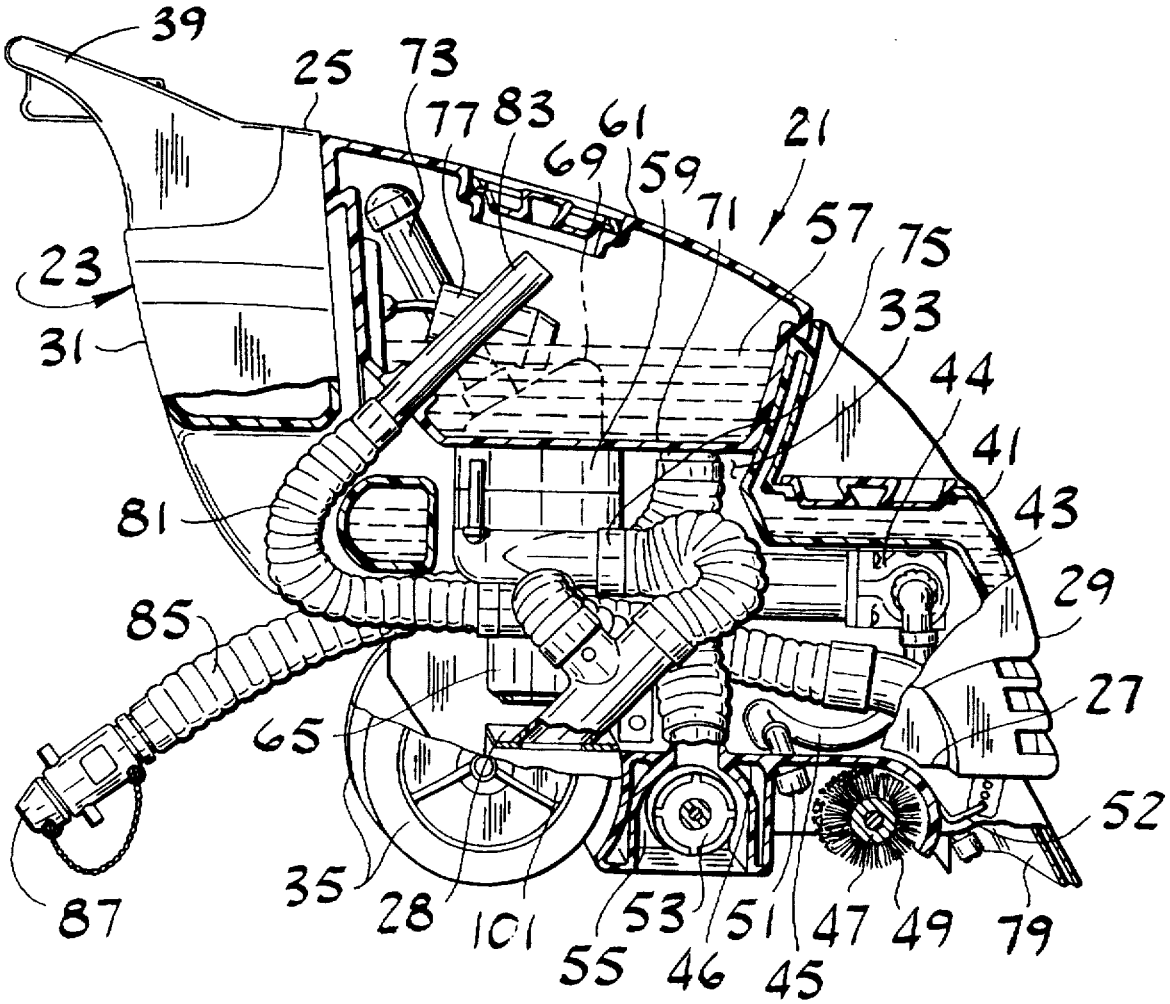
FIG. 1 is a side view of an extraction machine of this invention with parts removed to show details.

Referring now to FIG. 1, an extraction machine of the present invention for cleaning floor surfaces, such as carpeting, is indicated in its entirety by the reference numeral 21. The extraction machine comprises a main housing, indicated generally at 23, mounted on wheels 35 so the machine can readily be moved by an operator. The wheels may also be driven by a motor (not shown) to self-propel the extraction machine. A handle 39 mounted at the rear of the machine 21 provides the operator with a convenient means for guiding and maneuvering the extraction machine during operation. Suitable controls (not shown) on the handle 39 are provided for activating various operating components of the machine.

Figure 2:
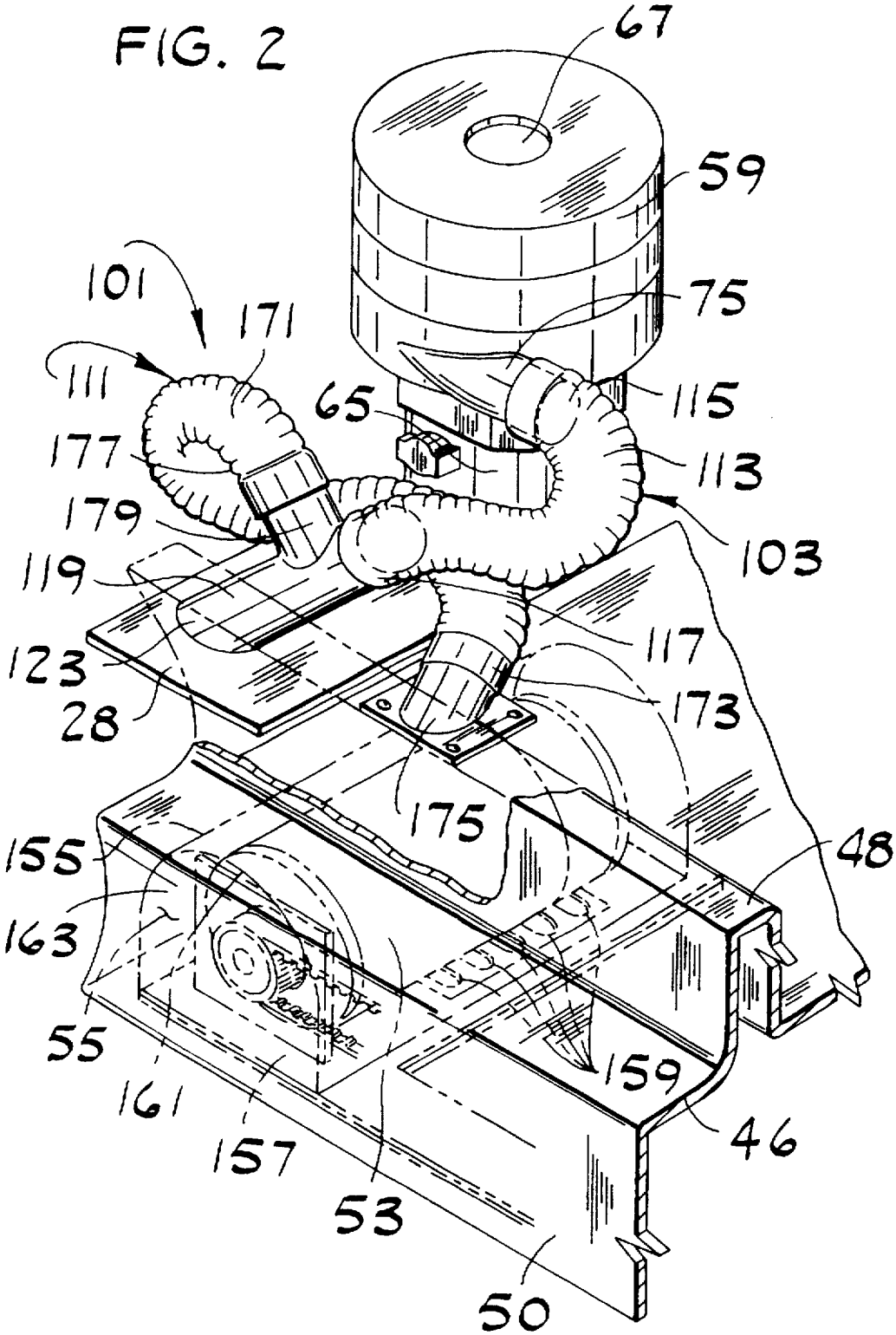
FIG. 2 is an enlarged perspective view of a portion of FIG. 1 showing a vacuum pump, vacuum motor, brush motor and cooling system of the extraction machine.

The main housing 23 has a top wall 25, a bottom wall 27, a front wall 29, a rear wall 31 and side walls (not shown), portions of which define a solution tank 41. The the main housing 23 also defines a cavity 33 which contains the operating components of the extraction machine 21. The bottom wall 27 of the main housing 23 is partially defined by plates 28 (one of which is shown in FIGS. 1 and 2) attached to the solution tank. The plates 28 are spaced apart in close relationship with each other to define interstices (not shown) between the plates. The interstices allow ambient air external to the main housing 23 to enter the cavity 33. It is understood that the main housing 23 may comprise a shell separate from the solution tank so that the solution tank is contained entirely within the main housing without departing from the scope of this invention.

The solution tank 41 holds a supply of cleaning solution 43 for cleaning the floor surface. A solution pump 44 communicates with the solution tank 41 to deliver cleaning solution from the tank to a feed line 45. A brush housing 46 having a top wall 48 and side walls 50 is attached to the underside of the main housing 23 (FIG. 2). It is contemplated, however, that the brush housing 46 may be located within the cavity 33 of the main housing 23 without deviating from the scope of this invention. A locator pin 52 is provided for releasably securing the brush housing 46 at a predetermined height above the floor and for adjusting the height of the brush housing depending on the depth of the carpet to be cleaned. The feed line 45 extends through the brush housing 23 to direct cleaning solution through an outlet 51 of the feed line onto the surface to be cleaned. A rotary scrub brush 47 mounted for rotation within the brush housing 46 has bristles 49 which contact the surface to be cleaned. The scrub brush 47 is preferably located close to the outlet 51 of the cleaning solution feed line 45 to encourage interaction between the scrub brush and the cleaning solution 43. The scrub brush 47 is driven by a brush motor 53 located in a compartment 55 in the brush housing 46 to effect a scrubbing action with the cleaning solution 43 to remove dirt on or within the floor surface. As dirt is removed from the surface, it attaches itself to the cleaning solution 43 to leave a dirty solution 57 on the surface of the floor.

A vacuum pump 59 is mounted within the cavity 33 directly below a solution recovery tank 61 seated in an opening 63 in the top wall 25 of the housing 23. The vacuum pump 59 and an associated suction fan (not shown) are driven by a vacuum motor 65, preferably an electric drive motor, mounted beneath the pump. The vacuum pump 59 has an intake 67 (FIGS. 2 and 3) which communicates by means of a hole 70 (FIG. 3) in a bottom wall 71 of the recovery tank 61 with the inside of a hollow air cap 69 (FIG. 1) sealingly attached to or integrally formed with the bottom wall of the recovery tank. A suction pipe 73 extends up from this cap 69 to a location adjacent the top of the recovery tank 61. The arrangement is such that operation of the vacuum pump 59 and associated suction fan draws air from the recovery tank to create a vacuum in the tank. The vacuum pump 59 has an exhaust 75 through which air from the suction fan is exhausted. A liquid level sensor 77 is provided for sensing the level of dirty solution 57 within the recovery tank 61. This sensor 77 is operable to shut off the extraction machine 21 before the solution level reaches the upper end of the suction pipe 73.

A vacuum shoe 79 (FIG. 1) is attached to the underside of the main housing 23 and extends between the housing and the floor surface so that the shoe and wheels 35 combine to support the extraction machine 21 in an upright position. The shoe 79 has a centrally located opening (not shown) extending upwardly therethrough. This opening is connected by means of a flexible recovery line or hose 81 to a rigid fill tube 83 extending up into the recovery tank 61, the upper end of the tube being at a level higher than that of the aforementioned level sensor 77. As the shoe 79 passes over the surface being cleaned the vacuum in the recovery tank 61 is sufficient to extract the dirty solution 57 from the floor surface through the opening in the shoe and up through the hose 81 and the fill tube 83 for delivery to the recovery tank 61. A drain line 85 with a closure 87 is provided for draining dirty solution 57 from the recovery tank 61 as needed.

Figure 3:
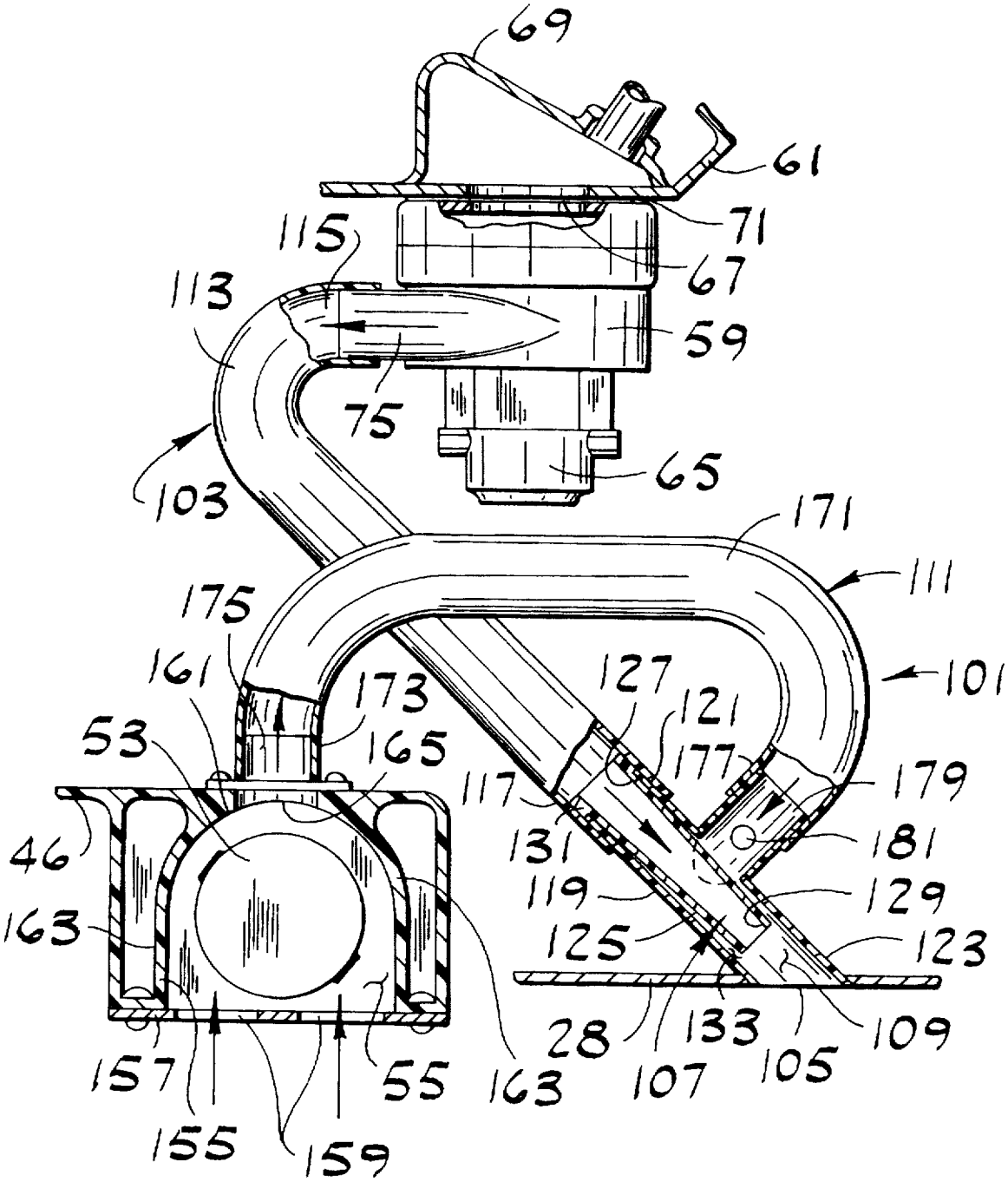
FIG. 3 is a side view of the vacuum pump, vacuum motor, brush motor and cooling system of FIG. 2.

In accordance with this invention, a cooling system, generally designated 101, is provided for cooling the brush motor 53 and other operating components within the cavity 33 of the main housing 23. As shown in FIG. 3, this system 101 includes an exhaust duct, generally designated 103, for conducting exhaust air pulled from the recovery tank 61 by the suction fan of the vacuum pump 59 to an opening 105 in bottom wall plate 28 of the main housing 23, a constriction, generally designated 107, in the exhaust duct 103 for reducing the pressure of exhaust air flowing through the exhaust duct to create a low pressure zone 109 adjacent the constriction, and a cooling duct, generally designated 111, connecting the brush motor compartment 55 and the low pressure zone 109 in the exhaust duct 103, all as explained in more detail below.

As best seen in FIGS. 2 and 3, the exhaust duct 103 comprises a length of flexible exhaust hose 113 having an inlet end 115 connected to the exhaust 75 of the vacuum pump 59 and an outlet end 117, and a substantially rigid exhaust pipe 119, also having an inlet end 121 and an outlet end 123, connecting the outlet end 117 of the flexible exhaust hose 113 to the opening 105 in bottom wall plate 28 of the main housing 23 so that exhaust air from the vacuum pump 59 is directed out of the main housing through the outlet end 123 of the exhaust pipe 119. The exhaust hose 113 is preferably flexible so that it can be configured to fit the main housing 23, but it will be understood that it could be rigid without departing from the scope of this invention. Similarly, the exhaust pipe 119 need not be absolutely rigid.

Figure 4:
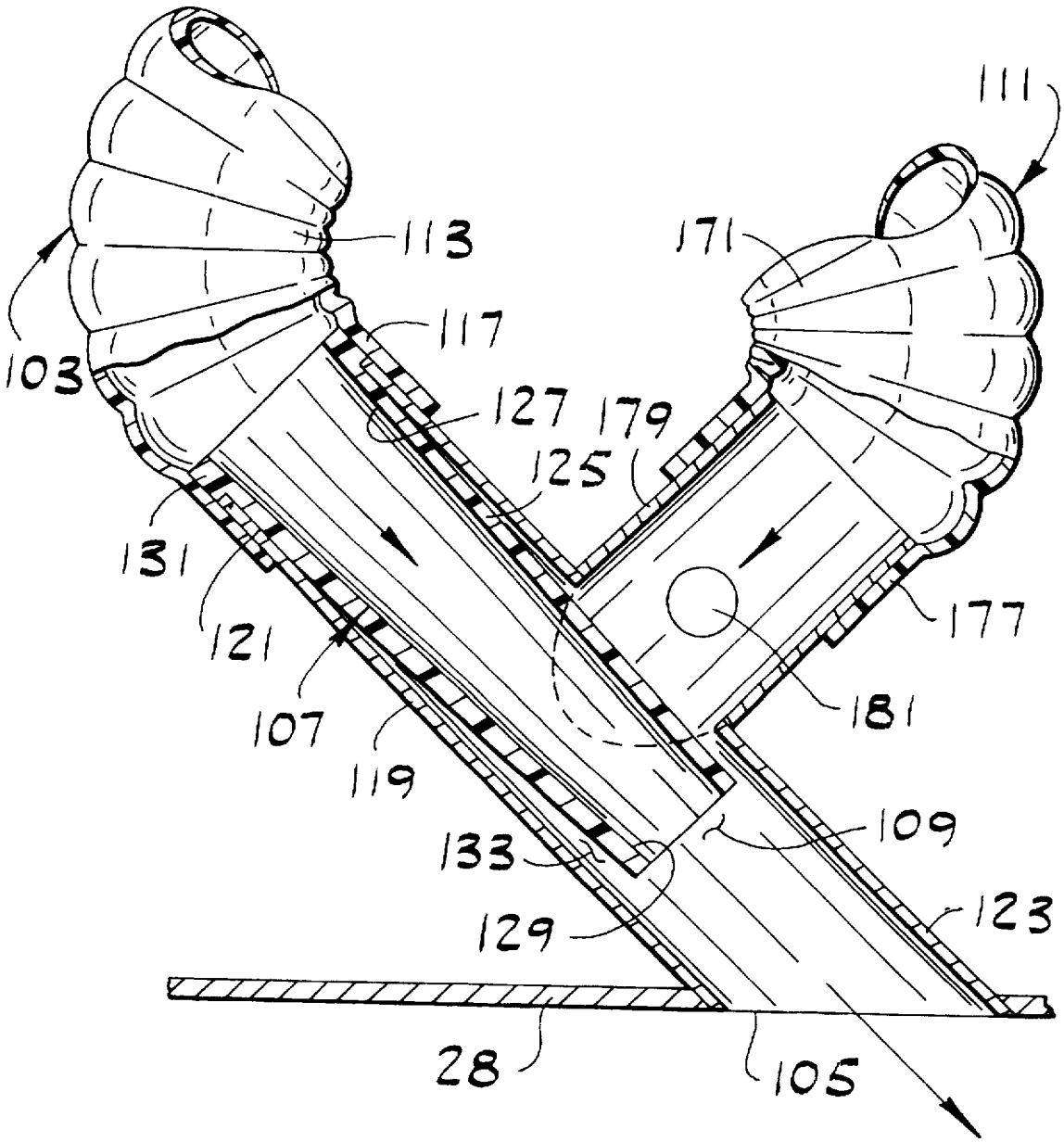
FIG. 4 is an enlarged side view of a portion of FIG. 3 showing a venturi tube of the cooling system.

FIGS. 3 and 4 illustrate that the constriction 107 in the exhaust duct 103 is formed by a venturi tube 125 disposed within the exhaust duct. The venturi tube 125 preferably extends longitudinally inside the exhaust pipe 119 in coaxial relationship with the exhaust pipe and has an upstream end 127 and a downstream end 129. The upstream end 127 of the venturi tube 125 extends beyond the inlet end 121 of the exhaust pipe 119 and preferably is secured to the exhaust pipe. The upstream end 127 of the venturi tube 125 is formed with an integral flange 131 which contacts the flexible exhaust hose 113 to form a sealed connection between the exhaust duct 103 and the venturi tube 125. In this manner, all of the exhaust air flowing through the exhaust duct 103 is directed into the upstream end 127 of the venturi tube 125. It is understood that the upstream end 127 of the venturi tube 125 may instead contact the inner surface of the exhaust pipe 119 to form a sealed connection between the venturi tube and the exhaust duct 103. It is also contemplated that structure other than a venturi tube may be located within the exhaust duct to constrict the flow of exhaust air, such as, for example, a baffle disposed within the exhaust duct and oriented to form a channel between the ramp and the exhaust duct which decreases in width toward the downstream end of the baffle, without departing from the scope of this invention.

The diameter of the venturi tube 125 gradually decreases as it extends longitudinally from its upstream end 127 to its downstream end 129. By way of example, the inside diameter of the upstream end 127 of the venturi tube 125 of the preferred embodiment is 1.68 in., while the inside diameter of the downstream end 129 is reduced to 1.25 in. In comparison, the exhaust pipe 119 has an inside diameter of 1.88 in. The decreasing diameter of the venturi tube 125 causes a widening gap 133 between the venturi tube and the exhaust pipe 119. The venturi tube 125 terminates upstream of the exhaust pipe outlet 123. For example, the venturi tube 125 may extend 3.63 inches into the exhaust pipe 119, while the overall length of the exhaust pipe is 6.50 inches. This allows exhaust air exiting the downstream end 129 of the venturi tube 125 to flow into the larger diameter exhaust pipe 119, thus creating the low pressure zone 109 adjacent the venturi tube.

Referring now to FIGS. 2 and 3, the compartment 55 for the brush motor 53 is defined by an enclosure 155 located within the brush housing 46. However, the enclosure 155 and compartment 55 may be located within the main housing 23 without departing from the scope of this invention. In the preferred embodiment, the bottom of the enclosure 155 is formed by a removable bottom plate 157 having openings defining a first compartment inlet 159 through which ambient air outside the brush housing 46 flows into the compartment 55. A pair of louvers define a second compartment inlet (not shown) in an end wall (not shown) of the enclosure 155. These louvers open to allow ambient air outside the brush housing 46 to flow into the compartment 55 when the first compartment inlet 159 is obstructed, such as by deep carpeting. The enclosure 155 is preferably of arched configuration, having a top wall 161, which forms the apex, and side walls 163 curving down from the apex at opposite sides of the brush motor 53. The side walls 163 of the enclosure 155 may also have holes therethrough to provide a third compartment inlet (not shown) for allowing ambient air to flow into the compartment 55. The top wall 161 of the enclosure 155 has a compartment outlet 165 through which air exits the compartment 55. The brush motor 53 is located within the compartment 55 so that air entering the compartment inlet 159 is directed around the brush motor before exiting through the outlet 165. While the brush motor 53 of the preferred embodiment is centrally located within the compartment 55, it is understood that the volume of air flowing around each side of the brush motor 53 is determined by the positioning of the brush motor within the compartment 55 relative to the side walls 163 of the enclosure. In this manner, more air may be directed to a particular side of the brush motor which generates greater heat, by locating the brush motor closer to the side wall 163 of the enclosure 155 opposite the particular side of the brush motor. The curved side walls 163 of the enclosure 155 direct the flow of air toward the outlet 165. It is contemplated, however, that the internal and external surfaces of the enclosure 155 may be of any shape and remain within the scope of this invention. In addition, the enclosure 155 may be oriented so that air flows through the compartment 55 in a side-to-side direction, as long as the air flows around the brush motor 53 before exiting the compartment.

The cooling duct 111 comprises a length of flexible cooling hose 171 having an inlet end 173 connected to a tubular fitting 175 projecting from the compartment outlet 165, and an outlet end 177, and a substantially rigid cooling pipe 179 connecting the outlet end 177 of the cooling hose 171 to the exhaust pipe 119 so that air from the compartment 55 is directed into the exhaust pipe and then exhausted from the housing 23. It is contemplated that the fitting 175 may be integrally formed with the enclosure 155 or may be releasably connected thereto. The cooling hose 171 is preferably flexible so that it can be configured to fit the housing 23, but it will be understood that it could be rigid without departing from the scope of this invention. Similarly, the cooling pipe 179 need not be absolutely rigid. The cooling pipe 179 is preferably joined to the exhaust pipe 119 at a location between the upstream and downstream ends 127, 129 of the venturi tube 125. This arrangement provides communication between the cooling duct 111 and the low pressure zone 109 within the exhaust duct. However, the cooling duct 111 may connect to the exhaust duct 103 downstream of the downstream end 129 of the venturi tube 125 and remain within the scope of this invention, as long as the connection provides communication between the cooling duct 111 and the low pressure zone 109 within the exhaust duct 103.

In operation, the exhaust air from the vacuum pump 59, having a pressure P1, flows through the exhaust duct 103 and enters the upstream end 127 of the venturi tube 125. As the diameter of the venturi tube 125 decreases, the flow of exhaust air through the venturi tube is constricted, which causes the velocity of the air to increase and its pressure to decrease. The reduced pressure exhaust air then flows into the exhaust pipe 119, which has a greater diameter than the downstream end 129 of the venturi tube 125, thereby forming the aforementioned zone 109 of low air pressure P2 within the exhaust pipe 119 adjacent the venturi tube 125. As the reduced pressure exhaust air flows within the exhaust pipe 119 downstream of the downstream end 129 of the venturi tube 125, the pressure gradually increases to ambient pressure. The low pressure zone 109 within the exhaust pipe 119 thus extends from within the gap 133 to a location downstream of the downstream end 129 of the venturi tube 125 where the reduced pressure exhaust air returns to ambient pressure.

Because the pressure P2 in the low pressure zone 109 is substantially less than ambient air pressure outside the main housing 23, the ambient air outside the main housing 23 is drawn into the compartment 55 through the compartment inlet 159 and around the brush motor 53 to effect cooling of the brush motor. This provides an efficient means of cooling the brush motor 53 without requiring additional electrical devices within the main housing 23, such as fan units. Air in the compartment 55 exits the compartment outlet 165 and is drawn through the cooling duct 111 and into the low pressure zone 109 within the exhaust pipe 119 where it mixes with the flow of exhaust air from the vacuum pump 59 to be exhausted through the opening 105 in the bottom wall plate 28 of the main housing 23.

The cooling system 101 of the present invention is also useful for cooling various operating components within the main housing 23. Heat generated by such operating components, including the vacuum motor 65 and electrical devices, causes the temperature of air within the cavity 33 to increase relative to the temperature of ambient air outside the main housing 23. The pressure of ambient air within the cavity 33 is substantially the same as the pressure of ambient air outside the main housing 23. A port 181 in the cooling pipe 179 provides communication between the low pressure zone 109 in the exhaust pipe 119 and the heated ambient air within the cavity 33 of the main housing 23. (Alternatively, the port 181 may be located in the cooling hose 171 or in the exhaust pipe 119, the exact location not being critical so long as the port provides communication between the cavity 33 and the low pressure zone 109 within the exhaust pipe 119.) By way of example, the diameter of the port 181 may be 0.50 inches. The pressure differential between the heated air in the cavity 33 and the air in the low pressure zone 109 in the exhaust pipe 119 causes the heated air to be drawn through the port 181 and into the cooling pipe 179, and then into the low pressure zone 109 within the exhaust pipe 119 for exhaust through the opening 105 in the bottom wall plate 28 of the main housing 23. As heated air from the cavity 33 is drawn into the cooling pipe 179, cooler ambient air outside the main housing 23 is drawn into the cavity 33 through the interstices in the bottom wall 27 of the main housing 23 to replace the heated ambient air. The cooler ambient air entering through the interstices circulates throughout the cavity 33 to effect cooling of the vacuum motor 65 and other operating components within the cavity of the main housing 23.

Referring to FIG. 3, the exhaust hose 113, exhaust pipe 119, venturi tube 125, cooling hose 171 and cooling pipe 179 are preferably constructed of plastic, but may also be constructed of metal. Additionally, it is contemplated that one or more of these elements may be integrally connected, such as the exhaust hose 113 and exhaust pipe 119, cooling hose 171 and cooling pipe 179, exhaust pipe 119 or exhaust hose 113 and venturi tube 125, exhaust pipe 119 and cooling pipe 179, or all five elements, to reduce the required number of fittings and connections. However, this is not essential to the present invention.

It will be observed from the foregoing that the cooling characteristics provided by the cooling system 101 of the present invention represent an improvement over conventional designs. As a result of the efficiencies provided by use of the venturi tube 125, more cooling air is drawn into the cavity 33 and directed to critical operating components, such as the brush motor 53, while using less energy. Also, since the operating temperatures of the various operating components (e.g., the brush motor 53) are reduced, there is less wear and tear on the extraction machine 21. Further, providing a cooling system 101 which employs a venturi tube 125 instead of additional motor driven cooling units results in a simple, more economical and energy efficient design.

While the cooling duct 111 of the preferred embodiment is connected to the compartment 55 for the brush motor 53, it is contemplated that the cooling duct may be connected to a compartment for a different motor or electrical component. Additionally, it is understood that multiple cooling ducts may be connected to more than one motor compartment to simultaneously provide direct cooling air to more than one motor and remain within the scope of this invention. The dimensions of the cooling system 101, such as the diameter of the exhaust pipe 119 and cooling pipe 179, the diameter and length of the venturi tube 125, etc. will vary depending on air flow, pressure, cooling requirements, machine design and available space.

It is further contemplated that the cooling system 101 of this invention can be used with other machines having motor-driven units other than the motor-driven vacuum pump 59 shown in the drawings. The central feature of the cooling system 101 is that the flow of air exhausted from a motor-driven unit is constricted by means of a venturi tube 125 to create a low pressure zone 109 which can be used to draw air over a secondary component.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A machine for extracting liquid from a surface, such as carpeting, said machine comprising, a main housing, a vacuum pump in the main housing for creating a vacuum to extract liquid from the surface, a motor in the main housing for driving said vacuum pump, said vacuum pump having an exhaust, an exhaust duct for conducting exhaust air from the exhaust of the vacuum pump to an opening in the main housing for exhaust to the environment, a constriction in said exhaust duct for reducing the pressure of exhaust air flowing through the exhaust duct from a first pressure upstream from the constriction to a second lower pressure in a low pressure zone adjacent the constriction, a compartment having an inlet for entry of ambient air into the compartment and an outlet for exit of air from the compartment, a second motor within the compartment, a cooling duct having an inlet communicating with the outlet of the compartment and an outlet communicating with said low pressure zone in said exhaust duct, said second lower pressure of the exhaust air in said low pressure zone being less than ambient pressure thereby to cause a flow of cooling ambient air into the compartment, through the compartment and into the cooling duct, and then into the exhaust duct for exhaust out of the main housing.

2. An extraction machine as claimed in claim 1 further comprising a venturi tube inside said exhaust duct forming said constriction, said venturi tube having an inlet for receiving substantially all of the exhaust air from said vacuum pump, and an outlet smaller in size than said inlet to constrict the flow of exhaust air through the venturi tube.

3. An extraction machine as claimed in claim 2 wherein said cooling duct outlet communicates with said exhaust duct between the inlet and outlet of said venturi tube.

4. An extraction machine as claimed in claim 2 wherein the cooling duct has an opening therein proximate the cooling duct outlet to allow air within the main housing to be drawn into the cooling duct.

5. An extraction machine as claimed in claim 2 wherein said exhaust duct comprises a substantially rigid exhaust pipe, and wherein said venturi tube extends generally coaxially inside the exhaust pipe and is spaced from the exhaust pipe to define a space communicating with said low pressure zone, said exhaust pipe having an upstream end attached to the venturi tube and a downstream end disposed downstream beyond the outlet of the venturi tube.

6. An extraction machine as claimed in claim 5 wherein the downstream end of the exhaust pipe is connected to the main housing.

7. An extraction machine as claimed in claim 5 wherein said cooling duct comprises a substantially rigid cooling pipe affixed to the exhaust pipe and communicating with said low pressure zone in the exhaust pipe.

8. An extraction machine as claimed in claim 7 wherein the exhaust duct comprises a first flexible hose connecting the vacuum pump and the upstream end of the exhaust pipe, and wherein the cooling duct comprises a second flexible hose connecting the outlet of the compartment and the cooling pipe.

9. An extraction machine as claimed in claim 8 wherein the exhaust pipe and cooling pipe are integrally connected to form a single fitting.

10. An extraction machine as claimed in claim 7 wherein the cooling pipe has an opening therein to allow air within the main housing to be drawn into the cooling pipe.

11. An extraction machine as claimed in claim 2 wherein said second motor is a brush motor for operating a cleaning brush.

12. A cooling system for use in a machine of the type comprising a main housing having an opening therein, a motor-driven unit in the main housing, a compartment having an inlet for entry of ambient air into the compartment and an outlet for exit of air from the compartment, and a motor in the compartment, the cooling system comprising an exhaust duct for conducting exhaust air from the motor-driven unit to the opening in the main housing, a constriction in said exhaust duct for reducing the pressure of exhaust air flowing through the exhaust duct from a first pressure upstream from the constriction to a second lower pressure in a low pressure zone adjacent the constriction, and a cooling duct connecting the outlet of said compartment to the low pressure zone in the exhaust duct, said second lower pressure of the exhaust air in said low pressure zone being less than ambient pressure thereby to cause a flow of cooling ambient air into said compartment, through the compartment and into the cooling duct, and then into the exhaust duct for exhaust through the exhaust duct outlet.

13. A cooling system as set forth in claim 12 further comprising a venturi tube inside said exhaust duct forming said constriction, said venturi tube having an inlet for receiving substantially all of the exhaust air from said motor-driven unit, and an outlet smaller in size than said inlet to constrict the flow of exhaust air through the venturi tube.

14. A cooling system as set forth in claim 13 wherein said exhaust duct comprises a substantially rigid exhaust pipe, and wherein said venturi tube extends generally coaxially inside the exhaust pipe and is spaced from the exhaust pipe to define a space communicating with said low pressure zone, said exhaust pipe having an upstream end attached to the venturi tube and a downstream end disposed downstream beyond the outlet of the venturi tube.

15. A cooling system as set forth in claim 14 wherein said cooling duct comprises a substantially rigid cooling pipe affixed to the exhaust pipe and communicating with said low pressure zone in the exhaust pipe.

16. A cooling system as set forth in claim 15 wherein the exhaust duct comprises a first flexible hose connecting the motor-driven unit and the upstream end of the exhaust pipe, and wherein the cooling duct comprises a second flexible hose connecting the outlet of the compartment and the cooling pipe.

17. A cooling system as set forth in claim 16 wherein the exhaust pipe and cooling pipe are integrally connected to form a single fitting.

18. A cooling system as set forth in claim 13 wherein the cooling duct has an opening therein to allow air within the main housing to be drawn into the cooling duct.

* * * * *